US005641017A

United States Patent [19]

Drake

[11] Patent Number: 5,641,017

[45] Date of Patent: Jun. 24, 1997

[54] LOCKING ASSEMBLY FOR MONITOR WELLS

[75] Inventor: Charles W. Drake, Orlando, Fla.

[73] Assignee: Charles Drake, Orlando, Fla.

[21] Appl. No.: 517,980

[22] Filed: Aug. 22, 1995

[51] Int. Cl.[6] ..... E21B 33/02

[52] U.S. Cl. ..... 166/92.1; 166/93.1

[58] Field of Search ..... 166/92.1, 97.1, 166/94.1, 85.1, 79.1, 75.11

[56] References Cited

U.S. PATENT DOCUMENTS 2,179,191 11/1939 McWilliams ..... 166/92.1
3,782,146 1/1974 Franke ..... 166/85.1 X
4,848,458 7/1989 Holdsworth et al. ..... 166/93.1 X
4,881,597 11/1989 Hensley ..... 166/92.1
4,971,149 11/1990 Roberts ..... 166/92.1

*Primary Examiner*—Frank Tsay
*Attorney, Agent, or Firm*—Thomas W. Tolpin

[57] ABSTRACT

An internal lock assembly securely locks a monitor well lid and cover to protect and safeguard the monitor well so as to enhance the monitor well's accuracy and environmental compliance. The user friendly lock assembly has a special latch which engages a padlock in a housing. A restraining bar across the front end of the housing restricts movement of the padlock's shackle. The internal housing can be supported by a mounting brace.

17 Claims, 3 Drawing Sheets

LOCKING ASSEMBLY FOR MONITOR WELLS

BACKGROUND OF THE INVENTION

This invention pertains to monitor wells and, more particularly, to a locking mechanisms for monitor wells.

Monitor wells are important for landfills, waste disposal sites, and areas around underground and above ground storage tanks to monitor for leakage, contamination, and environmental compliance. Monitor wells are useful to monitor water depth and fluctuations in the water table. Monitor wells are also useful to take samples of the water for chemical analysis to detect the presence of impurities, such as inorganic compounds, petroleum products, metals, and various pollutants which could be harmful to people, animals, fish, trees and plants. There are above ground monitor wells, slush mounted monitor wells, and underground and submerged monitor wells.

It is important that monitor wells be accurate and in good working condition to obtain accurate data and information. For these purposes, monitor wells are typically covered by a cover and lid to protect the monitor well from environmental hazards and stresses, such a rain, snow, sleet, hail, ice, wind, blazing sun, as well as from dust and dirt. The lid and cover are usually locked to prevent unauthorized persons from tampering with the monitor well as well as to prevent wildlife, e.g. deer, raccoons, gophers, etc. from damaging the monitor well.

Traditionally, monitor well covers and lids are locked with an external padlock located on the outside of the cover or lid. Unfortunately, the conventional arrangement causes many problems. The external padlock often rusts or otherwise become inoperable because of prolonged exposure to extreme climatic conditions, e.g. rain, snow, sleet, hail, ice, wind, dust, dirt, etc. Furthermore, external padlocks are readily accessible and can be tampered, jammed, damaged, cut or severed, e.g. with bolt cutters. Vandals can open external locks and gain access to tamper with, damage and/or dump waste in the monitor well.

It is, therefore, desirable to develop an improved locking assembly which overcomes most, if not all, of the preceding problems.

SUMMARY OF THE INVENTION

An improved locking assembly and process are provided to protect and safeguard monitor wells. Advantageously, the novel locking assembly and process are effective, dependable, economical, and easy to use.

To this end, the locking process includes: placing and positioning a lock, e.g. a padlock, between a monitor well and a monitor well cover; securely locking the monitor well cover to the monitor well lid; protecting the lock by preventing rain, snow, sleet, hail, ice, wind, dust, and dirt from contacting the lock; and deterring and preventing tampering of the lock. In the preferred process, the lock is secured with a latch which extends downwardly from the monitor well lid. Preferably, the lock is slid in a housing within the interior of the monitor well cover. A restraining bar or other device can be used to restrain and limit movement of the lock.

The special locking assembly features a lock to securely lock the monitor well cover to the monitor well lid and an environmental protection assembly to protect the lock from environmental conditions, such as rain, snow, hail, ice, sleet, wind, dust, dirt, etc. The locking assembly is also designed and arranged with anti-tampering construction to deter tampering of the lock and is positioned within the interior of the well cover. The locking assembly can include: a casing with a lock-receiving opening to slidably receive the lock, a latch which extends downwardly from the lid and cooperates with the lock to secure the monitor well cover and lid, and a restraining bar to limit and restrict movement of the lock.

In the preferred, form, the latch has a leg and a foot. The leg has a maximum width less than the span and size of the foot to pass through the lock opening between the shackle and body of the lock. The leg can have a shackle-engaging portion that is positioned adjacent the shackle. The foot size (length) is greater than the maximum width of the leg so that the foot of the latch can pass through the lock opening when the lock is open. The foot size, however, is larger than the lock opening when the lock is closed to prevent the foot from passing through the lock opening when the lock is closed. Desirably, the latch cooperates with the lock to keep the monitor well lid closed and prevent the lid from opening when the lock is closed.

In the illustrative embodiment, the housing provides a casing and shell which protects the lock. The housing has a back wall which is secured to the monitor well cover and has an access opening in communication with and for accessing the keyhole in the lock. The housing has an open front end to slidably receive the lock and has side walls extending between the back wall and open front end. The housing also has transverse or horizontal top and bottom walls with aligned latch-receiving openings to slidably receive the leg and foot of the latch.

A restraining bar can be connected to the sides of the housing near (adjacent) the open front end, such as with a cotter pin, bolt, screws, or other fasteners, to restrain movement of the shackle of the lock. The restraining bar can have a shackle-receiving opening to slidably receive the shackle.

A mounting brace can be provided to support the housing, such as in a horizontal position. The mounting brace can be connected to the bottom of the housing and the monitor well cover. The mounting brace can also have side walls, such as triangular or other shaped side walls, with a foot-receiving opening therebetween to accommodate entry and removal of the foot of the latch.

The inventive locking assembly has produced unexpected surprisingly good results.

A more detailed explanation of the invention is provided in the following description and claims.

DETAILED DESCRIPTION OF THE PREFERRED EMBODIMENTS

Figure 1:
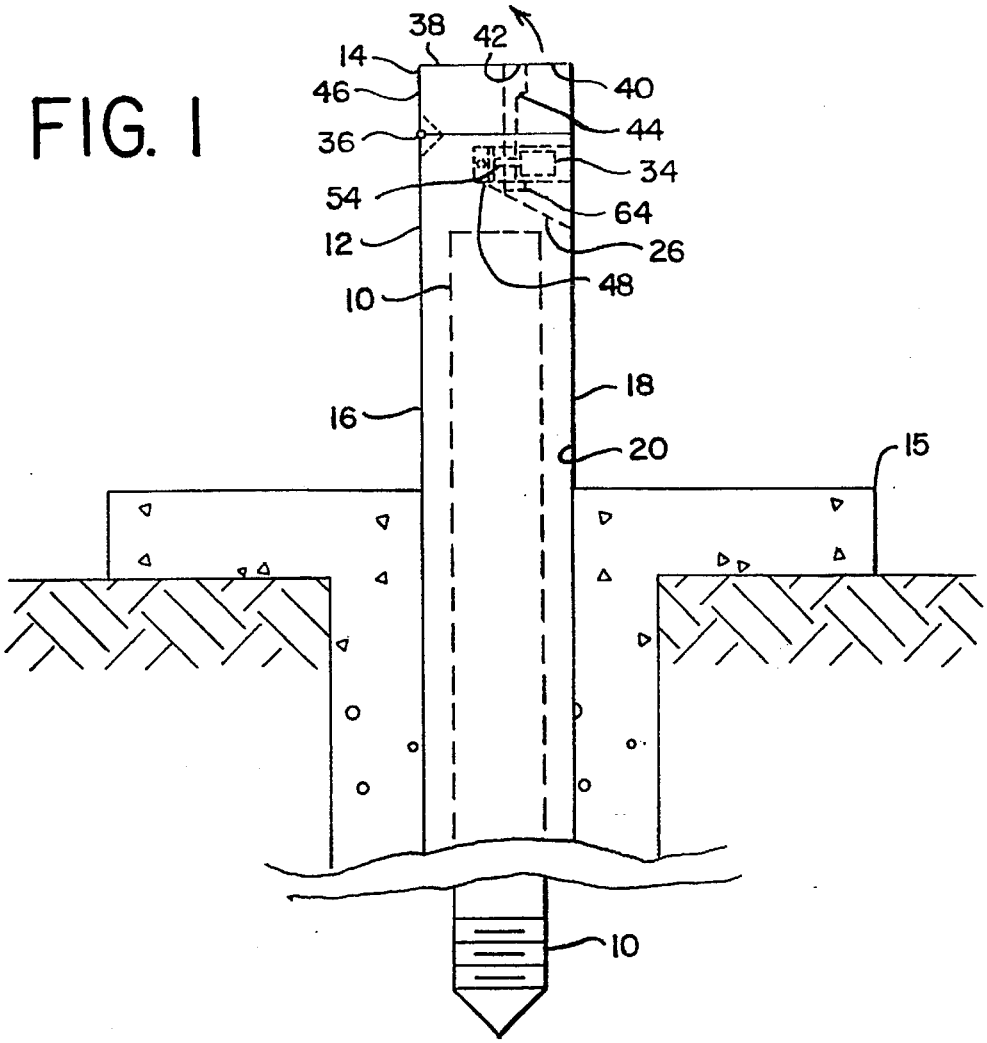
FIG. 1 is a diagrammatic view of the monitor well and locking assembly in accordance with principles of the present invention.

A monitor well 10 (FIG. 1) detects and measures the level of water or other liquid in an underground site, such as an aquifer, water table, ground surrounding an underground storage tank or aboveground storage tank, etc., and takes samples for analysis to determine if the water and underground site have been contaminated or polluted. The monitor well is located and extends into the underground site for groundwater monitoring or other environmental compliance. The monitor well can be used to procure (take) water samples and to help chemically analyze the samples to detect the presence, concentration and amount of petroleum products, inorganic compounds, lead and other metals, biochemical oxygen demand (BOD), chemical oxygen demand (COD), total organic carbon (TOC), trace elements and other impurities, that may be present in the water at the underground site being monitored. The monitor well is particularly useful to monitor changes in the composition and depth of groundwater or underground water. The monitor well can be an aboveground or above grade monitor well, an underground or submerged monitor well, or a flush mounted monitor well.

Figure 2:
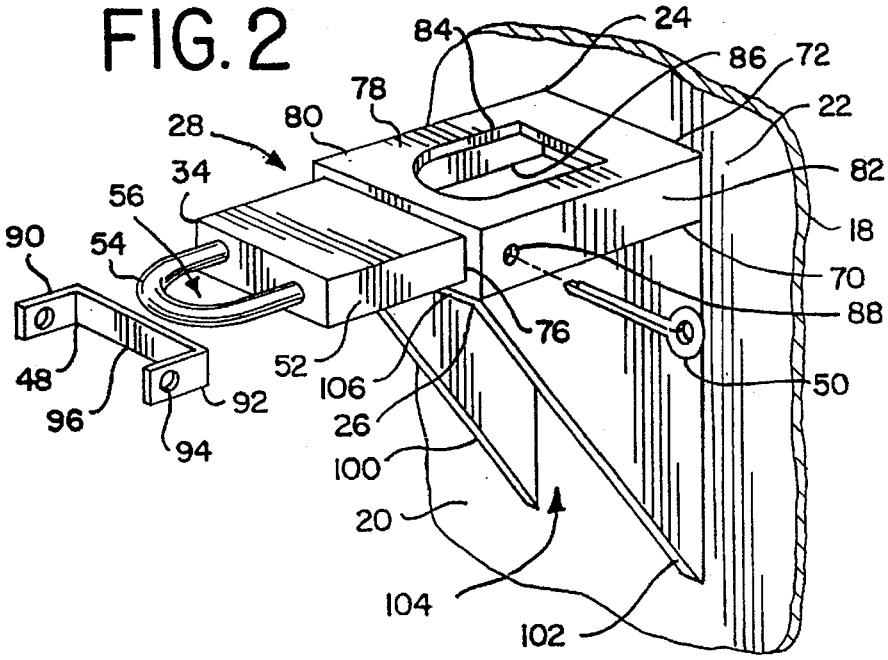
FIG. 2 is an enlarged perspective view of part of the locking assembly.
Figure 3:
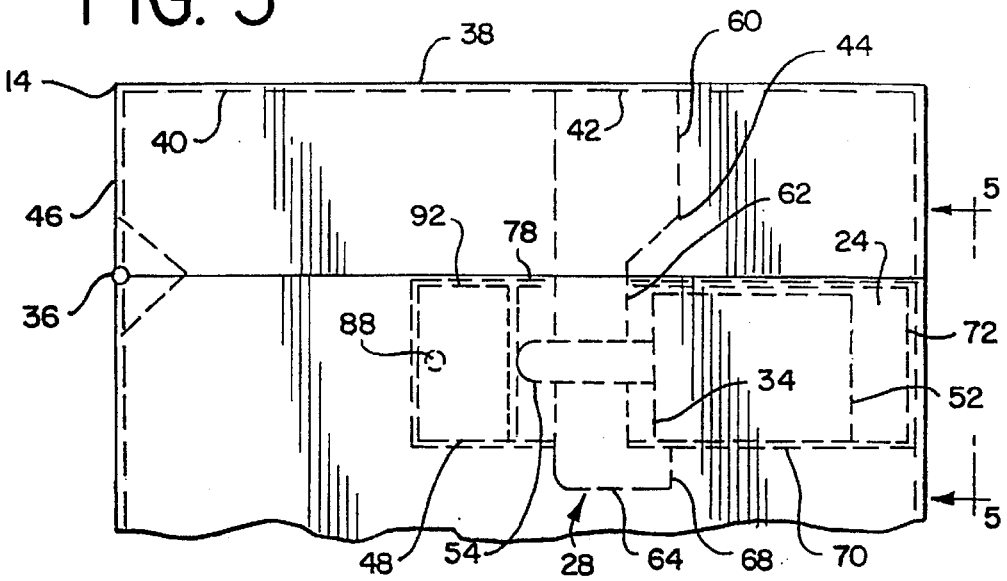
FIG. 3 is a fragmentary view of the monitor well lid and cover and illustrating in dotted line the locking assembly in a closed locked position.
Figure 4:
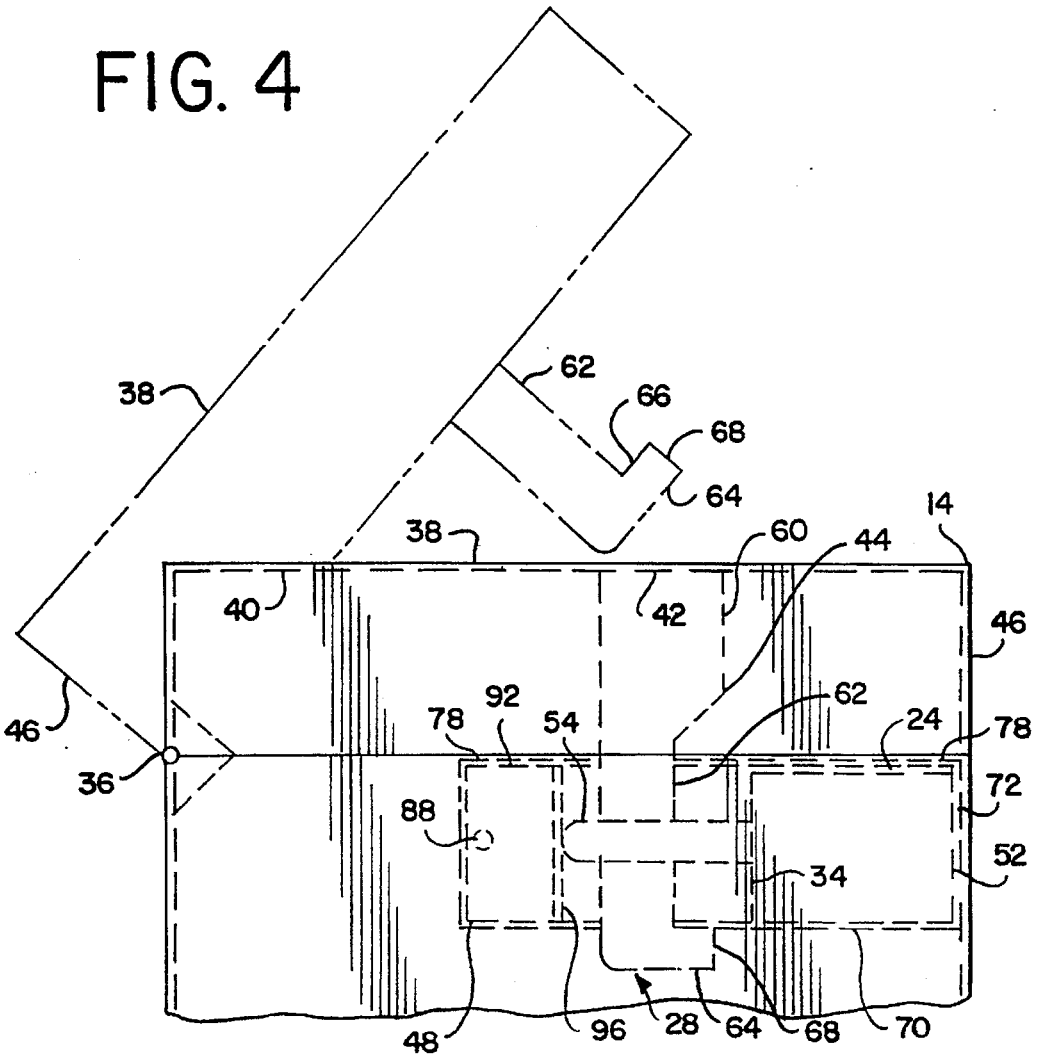
FIG. 4 is a view similar to FIG. 3 but illustrating the locking assembly in an open unlocked position and showing in phantom line the lid and latch pivoted to a partially open position.
Figure 5:
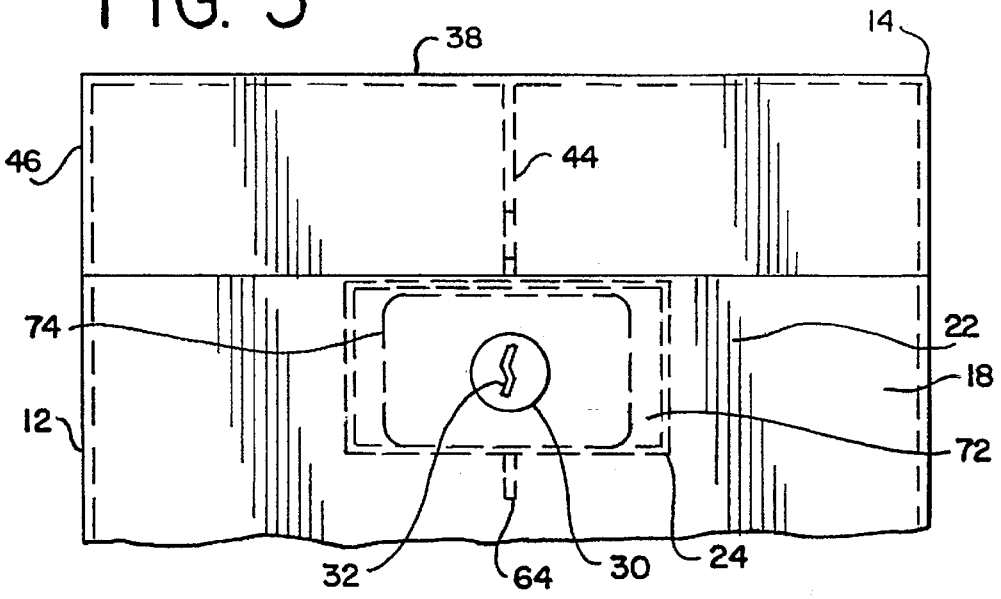
FIG. 5 is an end view of the monitor well lid, cover and locking assembly taken substantially along line 5—5 of FIG. 3.

The monitor well is protected by a monitor well cover 12 and monitor well lid (cap) 14 from external environmental conditions, such as wind, rain, snow, ice, sun, etc., as well as blowing dust and dirt. The monitor well lid and cover can be made of stainless steel or aluminum. Other types of material, such as fiberglass, impact-resistant plastic, wood, or other metal can be used for the monitor well cover and lid, if desired. The monitor well cover can be secured in a footing 15 or casing made of concrete or other material. The monitor well cover has upright rectangular walls 16 including a back wall 18. The cover's vertical walls 16 peripherally surround an upper portion of the monitor well. The vertical inner surfaces 20 of the cover's upright walls face the monitor well. The inner surface of the cover's vertical back wall, provides a supporting portion 22 (FIG. 2) which supports and is securely attached to a lock housing 24 and mounting brace 26 of a locking assembly 28. The supporting portion of the wall also has a keyhole opening 30 (FIG. 5) cut therein for access to a keyhole 32 of a lock 34 (FIGS. 2–4).

The monitor well lid 14 (FIGS. 3 and 4) can be hinged and pivotally connected to the cover 12. To this end, one or more hinges 36 can be fastened by screws or other fasteners to the upper edge of the cover 12 and the lower edge of the lid 14. The lid is moveable and pivots from an open lid position to permit access to the monitor well, to a closed lid position to prevent access to the monitor well. In some circumstances, it may be desirable not to use hinges and allow the lid to be removed from the cover.

The lid has a rectangular top 38 positioned above and protectively covering the monitor well. The underside 40 of the lid provides a latch-connecting surface 42 upon which a locking latch 44 is securely connected. The lid has a rectangular or annular skirt with downwardly depending wall portions 46 extending integrally downwardly therefrom. The lid's vertical wall portions are aligned in vertical registration with the cover's upright walls 16. The top of the lid extends transversely and horizontally across the lid's vertical wall portions and connects the lid's vertical wall portions. While the illustrated monitor well cover and lid cover have a rectangular cross section, it may be desirably in some circumstances to use a different shaped monitor well cover and lid, such as a monitor well cover and lid with a circular or cylindrical cross section, polygonal cross section or a differently shaped cross section.

A locking assembly 28 (FIGS. 2–4), also referred to as a lock assembly, securely and releasably locks the monitor well cover to the monitor well lid to limit access to the monitor well to authorized personnel. The locking assembly also protects the accuracy, integrity, operability and reliability of the monitor well. The locking assembly includes a lock 34, such as a padlock, a latch 44 (FIGS. 3 and 4), a housing 24 (FIG. 2), a mounting brace 26, a restraining bar 48, and a cotter pin 50.

The lock 34 is positioned within the housing 24. A padlock, such as Masterlock model #5 is useful, although other types and sizes of locks can be useful in some circumstances. The body 52 of the lock has a keyhole 32 (FIG. 5) which is positioned in alignment with the keyhole opening 30 in the cover's back wall. A shackle 54 (FIG. 2) comprising a generally U-shaped shank is operatively connected to the body of the lock. The shackle is moveable from a closed locked position to an open unlocked position. The shackle cooperates with the body of the lock to provide a leg-receiving opening 56, also referred to as a latch-receiving opening or lock opening, therebetween. One end of the shackle is pivotally connected to the lock's body in the open unlocked position. Both ends of the shackle are securely connected to the lock's body in the closed locked position. An internal spring in the lock's body urges the shackle to spread open in the unlocked position. In some circumstances, it may be desirable to use a shackle which completely separates and is fully removable from the lock's body.

An elongated vertical L-shaped metal latch 44 (FIGS. 3 and 4) is cantilevered downwardly from and secured to the underside of the lid by welding, bolts, adhesive, glue, or other connection means. The upper section of the latch comprises an enlarged head 60 which provides an upper attached portion that is fixedly connected to and extends vertically downwardly from the underside of the lid. The head of the latch has a width and thickness which is greater than the leg-receiving opening (lock opening) of the lock when the lock is in the locked position. The intermediate section 62 of the latch comprises an elongated leg that extends integrally and vertically downwardly from the upper attached head portion of the latch. The leg also has a shackle-engaging portion. The leg 62 is inserted and positioned within and engages the leg-receiving opening of the lock when the lid in the closed position. The head has a tapered neck portion adjacent the upper portion of the leg. The leg has a maximum transverse span (maximum width) that is less than the width of the head, as well as less than the maximum span of the lock's leg-receiving opening when the lock is in the closed locked position.

The bottom section 64 of the latch comprises a foot that extends downwardly from the leg 62. The foot 64 also extends horizontally and transversely toward the supporting portion of the cover's back wall. The foot has a length (transverse span) and size greater that the maximum width of the leg. The foot is also larger that the span of the leg-receiving opening of the lock when the lock is in the closed locked position but is smaller than the leg-receiving opening of the lock when in the lock is in the open unlocked position. The foot has an instep 66 (FIG. 4) which provides a lock-engaging dorsum portion that is securely positioned below the body of the lock and the bottom 70 of the housing when the lock is in the locked position. The foot further has a toe section 68 which faces the supporting portion of the cover's back wall. Desirably, the foot cooperates with the lock to keep the monitor well lid closed and prevent the lid from opening when the lock in the closed locked position.

A rectangular internal housing 24 (FIGS. 2–4) receives, holds and protects the lock 34. The housing comprises a box, shell and tubular casing which extends transversely and horizontally inwardly from and is securely cantilevered to the supporting portion of the cover's back wall. The housing has a back wall 72 comprising a rectangular annular face plate that is positioned against and welded, bolted, bonded or otherwise secured to the supporting portion of the cover's back wall. The face plate has an access opening 74 (FIG. 5) which is positioned between and aligned in horizontal registration with the keyhole of the lock and the keyhole opening in the cover's back wall. The housing has an open front end 76 (FIG. 2) which provides a lock-receiving opening to slidably receive the lock so that the lock can be positioned within the housing. The housing has transverse horizontal, rectangular, symmetrical, top and bottom walls 78 and 70, respectively, and upright vertical side walls 80 and 82 which extend between and connect the top and bottom walls. The top and bottom walls have aligned arched latch-receiving openings 84 and 86 which receive the leg 62 (FIG. 3) and foot 64 of the latch 44 when the monitor well lid is closed, i.e. in the closed position. The foot of the latch abuts against and engages the lower exterior downwardly facing surface (underside) of the housing's bottom wall 70 when the lock is in the closed locked position. The side walls have horizontally aligned, cotter pin-receiving openings 88 adjacent the front end of the housing.

Figure 6:
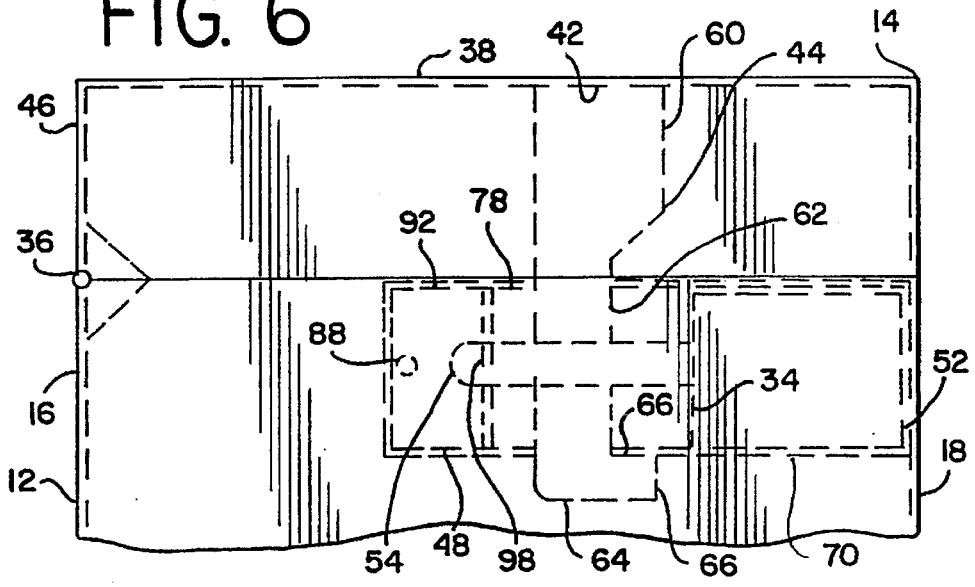
FIG. 6 is a view similar to FIG. 3 but with the restraining bar Of FIG. 7.
Figure 7:
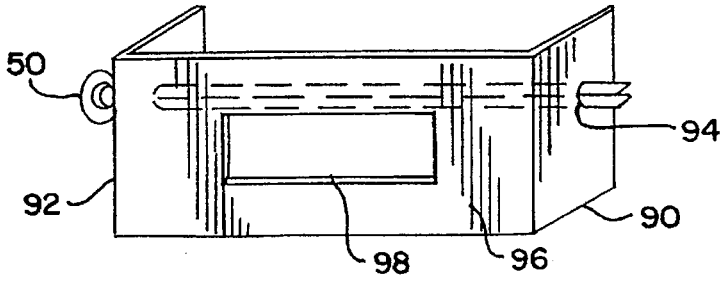
FIG. 7 is a perspective view of a cotter pin and restraining bar with a shackle-receiving opening therein.

A generally U-shaped metal restraining bar 48 (FIG. 2) or bracket is provided to restrain, restrict, control, and limit movement of the shackle 54 of the lock 34. The restraining bar has sides 90 and 92 which engage and are positioned against the side walls of the housing. The sides of the restraining bar have cotter pin-receiving openings 94 what are aligned in registration with the cotter pin-receiving openings 88 of the side walls of the housing. The intermediate portion 96 of the restraining bar comprises a rectangular bight. The bight 96 provides a solid imperforate abutment wall which extends between and connects the sides of the restraining bar. The bight of the restraining bar is positioned across the open front end of the housing in proximity to the shackle of the lock to restrain, restrict and limit movement of the shackle of the lock. The bight can be solid as shown in FIG. 2, or can have a rectangular or oblong slot 98 providing a shackle-receiving opening, as shown in FIG. 7 to slidably receive the bent, curved portion (bight) of the shackle 54 (FIG. 6).

A cotter pin 50 extends through the cotter-pin receiving openings 94 of the sides of the restraining bar and the cotter-pin receiving openings 88 (FIGS. 2–4 and 6) of the side walls of the housing, to securely connect the restraining bar to the housing. The abutment wall (bight) 96 of the restraining bar cooperates with the cotter pin 50 to prevent the lock's body from moving through the front end of the housing when the lock is in the housing in either the locked and unlocked position.

A mounting brace 26 (FIG. 2) or shelf supports the housing. The preferred mounting brace has right triangular side walls 100 and 102 which are welded, bonded, bolted, or otherwise securely connected to the supporting portion of the cover's back wall. The triangular side walls extend integrally vertically downwardly from a horizontal intermediate brace portion 106 which is welded, bonded, bolted, or otherwise securely connected to the bottom of the housing. The mounting brace has a foot-receiving opening 104 in the intermediate brace portion between the triangular walls of the mounting brace to accommodate entry and removal of the foot of the lock. In some circumstances, it may be desirable to use other types and shapes of mounting braces. The mounting brace and the housing are mounted above or to the side of the upper portion of the monitor well.

In order to install and assemble the locking assembly, a keyhole opening 30 (FIG. 5) is cut in the cover's back vertical wall 18. The bottom of the housing (box) and top of the mounting brace (shelf) are welded, bolted, bonded, or otherwise secured to each other. The back of the housing and mounting brace are welded, bolted, or otherwise secured to the cover's back wall so that the keyhole-opening of the cover's back wall is aligned with the access opening in the back of the housing. The padlock is opened and inserted into the open front end of the housing (body first and then the shackle). The padlock is slid towards the back of the housing so that the lock's keyhole is in proximity to the access opening of the housing back wall and the keyhole-opening of the cover's back wall. There should be sufficient clearance and spacing between the key hole end of the lock's body and the back wall of the housing to allow the lock to spread open towards the back wall when the lock is opened. The restraining bar is then placed across the front end of the housing so that the bight or abutment surface of the restraining bar abuts against or is positioned closely adjacent the bend (bight) of the shackle. The cotter pin is inserted into the cotter pin-receiving openings of the restraining bar and housing and the bifurcated ends of the cotter pin are bent to secure the cotter pin to the restraining bar and the housing.

To securely lock the monitor well lid to the cover, first close the monitor well lid. When the lid is closed, the latch moves downwardly so that the foot of the latch passes through the latch-receiving opening (lock opening) of the lock between the shackle (shank) and body of the lock, and the latch's leg (intermediate portion of the latch) passes and is positioned into the latch-receiving opening of the lock. A key, finger, pen, instrument or tool is inserted through the keyhole-receiving opening of the cover's back wall and through the access opening of the housing's back wall to push the lock's body against the shackle to close (lock) the lock. When the lock is closed, the lock is securely locked to and around the latch and the monitor well lid is securely locked to the monitor well cover. The key, finger, pen, instrument or tool is removed after the lock is closed.

To open the monitor well lid, simply insert the lock's key into the keyhole of the lock via the access opening in the housing's back wall and the keyhole-receiving opening of the cover's back wall. The key is turned to unlock (open) the lock and the key is removed. When the lock is opened, the lid can be lifted (opened) to raise the leg and foot of the latch out of the latch-receiving opening (lock opening) of the lock.

Among the many advantages of the locking assembly and process for the monitor well are:

1. Assures the protection and integrity of the monitor well.
2. Prevents tampering of the monitor well.
3. Enhances environmental compliance.
4. Protects the lock and monitor well from climatic conditions, dust and dirt.
5. Outstanding performance.
6. Superior quality.
7. Beneficial to the environment.
8. Easy to use.

9. Attractive.

10. Economical.

11. Reliable.

12. Efficient.

13. Effective.

Although embodiments of the invention have been shown and described, it is to be understood that various modifications and substitutions, as well as rearrangements of parts, components, and process steps, can be made by those skilled in the art without departing from the novel spirit and scope of this invention.

What is claimed is:

1. A locking assembly, comprising:

lock means for locking a monitor well cover to a monitor well lid;

environmental protection means for substantially protecting said lock means from rain, snow, hail and dust; and means for positioning said lock means within the interior of the monitor well cover.

2. A locking assembly in accordance with claim 1 including anti-tampering means for substantially deterring tampering of said lock means.

3. A locking assembly in accordance with claim 1 wherein said means for positioning said lock means comprises a casing with a lock-receiving opening for slidably receiving said lock means.

4. A locking assembly in accordance with claim 1 wherein said lock means includes a lock and a latch extending downwardly from the monitor well lid.

5. A locking assembly in accordance with claim 1 including restraining means for limiting movement of said lock means.

6. A locking assembly comprising:

lock means for locking a monitor well cover to a monitor well lid;

environmental protection means for substantially protecting said lock means from rain, snow, hail and dust;

a latch extending downwardly from said monitor well lid, said latch having a leg and a foot, said leg having a maximum width less than the span of said foot for passing through and positioning within a lock opening between a shackle and a body of a lock, said leg having a shackle-engaging portion for positioning adjacent the shackle, said foot spanning a length greater than the maximum width of the leg for passing through the lock opening when the lock is open but being larger than the lock opening when the lock is closed to prevent said foot from passing through the lock opening when the lock is closed, and said latch cooperating with the lock to keep the monitor well lid closed and prevent the lid from opening when the lock is in a closed and prevent the lid from opening when the lock is in a closed position;

a housing for protecting the lock, said housing having a back wall secured to the monitor well cover and defining an access opening in communication with and for accessing a keyhole in the lock, said housing having an open front end for slidably receiving the lock and having side walls extending between said back wall and the open front end, said housing having transverse walls extending between and connecting said side walls, said transverse walls comprising a top wall and a bottom wall and defining latch-receiving openings for slidably receiving the leg and foot of said latch; and a restraining bar connected to said sides of the housing adjacent the open front end for restraining movement of the shackle of the lock.

7. A locking assembly in accordance with claim 6 wherein said restraining bar has a shackle-receiving opening for slidably receiving the shackle of the lock.

8. A locking assembly in accordance with claim 6 including a mounting brace connected to said housing and the monitor well cover for supporting said housing in a substantially horizontal position.

9. A locking assembly in accordance with claim 8 wherein said mounting brace has sidewalls and a foot-receiving opening therebetween for accommodating entry and removal of the foot of said latch.

10. A locking process, comprising the steps of:

placing a lock between a monitor well and a monitor well cover;

securing the monitor well cover to a monitor well lid with said lock;

substantially preventing rain and snow from contacting the lock;

substantially preventing tampering of said lock; and wherein said placing includes sliding said lock in a housing within the interior of the monitor well cover.

11. A locking process in accordance with claim 10 including securing said lock with a latch extending downwardly from the lid.

12. A locking process in accordance with claim 10 including restraining movement of the lock.

13. A locking assembly, comprising:

a monitor well for monitoring an underground site for environmental compliance, said monitor well being located in proximity to said site for measuring water depth and for taking water samples for analysis;

a monitor well cover having upright walls peripherally surrounding at least a portion of said monitor well, said walls having inner surfaces facing said monitor well, and one of said inner surfaces having a supporting portion and defining a keyhole opening;

a lid hinged and pivotally connected to said cover at an elevation above said supporting portion, said lid being moveable from an open lid position to permit access to said monitor well to a closed lid position to prevent access to said monitor well, said lid having a top positioned above and protectively covering said monitor well, said lid having a skirt comprising downwardly depending wall portions extending integrally downwardly from said skirt and aligned in substantially vertical registration with said upright walls of said cover, said top extending transversely across and connecting said wall portions, and said top having an underside;

a lock having a body with a keyhole positioned in alignment with said keyhole opening in said cover, a shackle comprising a generally U-shaped shank operatively connected to said body, said shackle being moveable from a closed locked position to an open unlocked position, and said shackle cooperating with said body to define a leg-receiving opening therebetween;

an elongated latch cantilevered downwardly from and secured to said lid, said latch having a head providing an upper attached portion fixedly connected to and extending downwardly from the underside of the top of said lid, said head having a width and thickness greater that said leg-receiving opening of said lock when said lock is in the locked position, said latch having a leg extending integrally downwardly from said upper attached portion for insertion within and engaging said leg-receiving opening of said lock when said lid is in the closed position, said leg having a maximum width less than the width of said head and less than the span of the leg-receiving opening of the lock when said lock in the locked position, said latch having a foot extending downwardly from said leg, said foot having a length defining a size greater than the maximum width of said leg and greater than the span of the leg-receiving opening of the lock when said lock is in the locked position but less than the maximum span of the leg-receiving opening of the lock when said lock is in the open unlocked position, said foot having an instep providing an upper lock-engaging dorsum portion for being securely positioned below the body of the lock in the locked position and having a toe section facing the supporting portion of the upright walls of the cover, and said latch cooperating with said lock to keep said lid closed and prevent said lid from opening when said lock is in the locked position;

a housing for receiving and protecting said lock, said housing comprising a shell extending transversely inwardly from and being securely cantilevered to the supporting portion of the upright walls of said monitor well cover, said housing having a back wall comprising a face plate secured to the supporting portion of said monitor well cover, said face plate defining an access opening positioned between and aligned in registration with said keyhole of said lock and said keyhole opening of said cover, said access opening being at least as large as said keyhole, said housing having an open front end defining a lock-receiving opening for slidably receiving said lock to permit said lock to be positioned in said housing, said housing having a top wall, a bottom wall and upright side walls extending between and connecting said top wall and said bottom wall, said side walls defining aligned cotter pin-receiving openings, said top wall and said bottom wall defining aligned latch-receiving openings for receiving said leg and said foot of said latch when said lid is in the closed position, said bottom wall having a lower exterior surface, and said foot engaging said lower exterior surface of the said bottom wall when said lock is in the locked position;

a generally U-shaped restraining bar having sides for engaging and positioning against the side walls of said housing adjacent said open front end, said sides defining cotter pin-receiving openings aligned in registration with the cotter pin-receiving openings of said side walls of said housing, and said restraining bar having a bight comprising an intermediate portion providing an abutment wall extending between and connecting said sides of said restraining bar for positioning across said open front end of said housing in proximity to said shackle of said lock; and a cotter pin extending through said cotter pin-receiving openings of said sides of said restraining bar and said side walls of said housing for connecting said restraining bar to said housing, and said abutment wall cooperating with said cotter pin to prevent said body of said lock from moving through said front end of said housing after said lock has been positioned in said housing.

14. A locking assembly in accordance with claim 13 wherein said abutment wall of said restraining bar defines a shackle-receiving opening.

15. A locking assembly in accordance with claim 13 wherein said monitor well comprises an aboveground monitor well.

16. A locking assembly in accordance with claim 13 wherein said monitor well comprises an underground monitor well.

17. A locking assembly in accordance with claim 13 including a mounting brace for supporting said housing, said mounting brace having substantially triangular walls securely connected to said supporting portions of the upright walls of said cover and to the bottom wall of said housing, and said triangular walls cooperating with each other to define a foot-receiving opening therebetween for accommodating entry and removal of the foot of said latch.

* * * * *